US007150217B2

(12) United States Patent
Kershaw

(10) Patent No.: US 7,150,217 B2
(45) Date of Patent: Dec. 19, 2006

(54) PROTECTIVE BODY ARMOR

(75) Inventor: Mark E. Kershaw, Macclesfield (GB)

(73) Assignee: Sportsfactory Consulting Limited, Cheshire (GB)

( * ) Notice: Subject to any disclaimer, the term of this patent is extended or adjusted under 35 U.S.C. 154(b) by 0 days.

(21) Appl. No.: 10/800,519

(22) Filed: Mar. 15, 2004

(65) Prior Publication Data

US 2005/0019524 A1 Jan. 27, 2005

Related U.S. Application Data

(63) Continuation of application No. PCT/GB02/03998, filed on Aug. 27, 2002.

(30) Foreign Application Priority Data

Sep. 15, 2001 (GB) ..... 0122328.8

(51) Int. Cl.
*F41H 1/02* (2006.01)

(52) U.S. Cl. ..... 89/36.05; 89/36.02; 2/2.5

(58) Field of Classification Search ..... 89/36.05, 89/36.02; 2/2.5

See application file for complete search history.

(56) References Cited

U.S. PATENT DOCUMENTS

| | | | | |
|---|---|---|---|---|
| 3,391,038 A | | 7/1968 | Whitesides | 156/78 |
| 3,835,509 A | * | 9/1974 | Esterdahl | 27/19 |
| 4,354,280 A | | 10/1982 | Hayes | 2/16 |
| 4,483,020 A | * | 11/1984 | Dunn | 2/2.5 |
| 4,525,875 A | * | 7/1985 | Tomczak | 2/463 |
| 4,931,340 A | * | 6/1990 | Baba et al. | 428/73 |
| 5,349,893 A | | 9/1994 | Dunn | 89/36.05 |
| 5,477,558 A | * | 12/1995 | Volker et al. | 2/461 |
| 5,683,781 A | * | 11/1997 | Komarek et al. | 428/116 |
| 5,770,291 A | * | 6/1998 | Tambussi | 428/55 |
| 5,855,984 A | | 1/1999 | Newton | 428/118 |
| 5,916,664 A | | 6/1999 | Rudy | 428/178 |
| 6,151,714 A | | 11/2000 | Pratt | 2/24 |
| 6,277,773 B1 | * | 8/2001 | Ward et al. | 442/409 |
| 6,295,648 B1 | * | 10/2001 | Siman-Tov et al. | 2/2.5 |

FOREIGN PATENT DOCUMENTS

| | | | |
|---|---|---|---|
| FR | 2 693 942 A1 | | 1/1994 |
| GB | 2 245 485 A | * | 1/1992 |

* cited by examiner

*Primary Examiner*—Stephen M. Johnson
(74) *Attorney, Agent, or Firm*—Baker Botts L.L.P.

(57) ABSTRACT

A cup-shaped protective body armour (10) to give impact protection is in the form of an outer skin (11) and a honeycomb lining (13) formed integrally with each other of a substantially non-deformable material. The honeycomb lining (13) is on the concave face (12) of the outer skin (11) and is formed by hexagonal cells (14) bounded by walls (15) upstanding from the outer skin (11) in common direction parallel with the central perpendicular (P) to the outer skin (11). A variation in thickness of the outer skin (11) provides fold lines (16) free from walls (15) of the honeycomb lining (13) extending across the body armour (10) to facilitate the conforming of the body armour (10) to the contours or a person wearing it. In addition, wedge-shaped cuts (17) extend along a portion of a fold line (16) from the outer edge (18) of the body armour (10).

18 Claims, 1 Drawing Sheet

Fig. 1
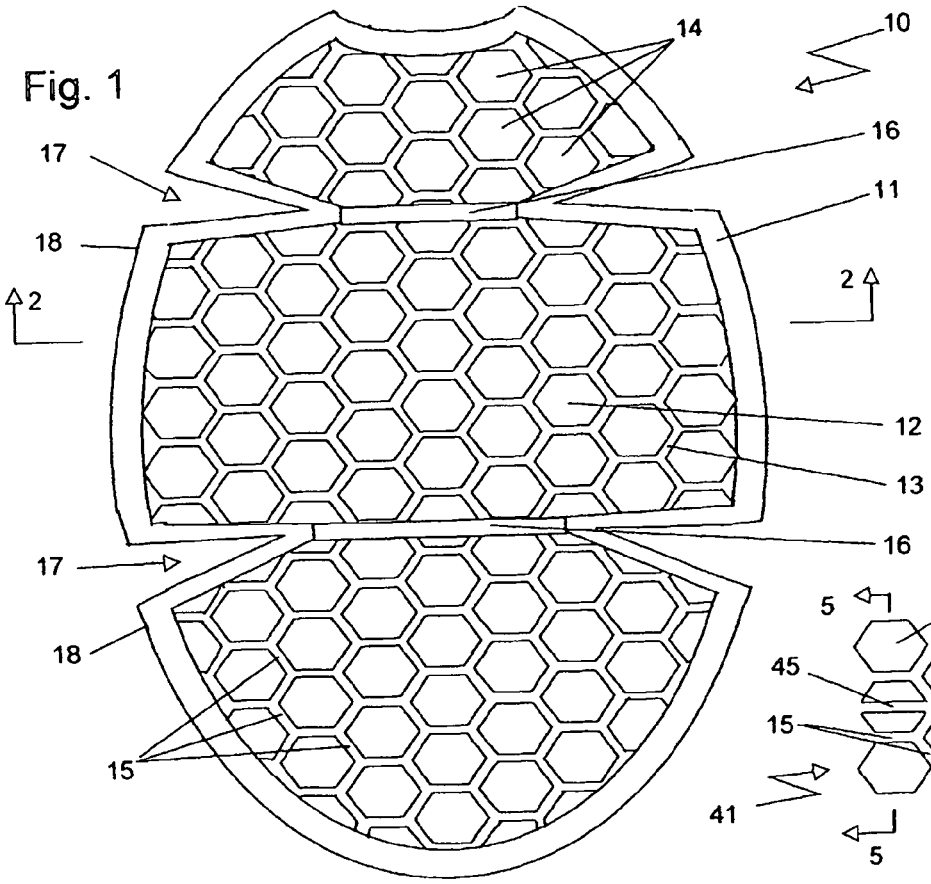
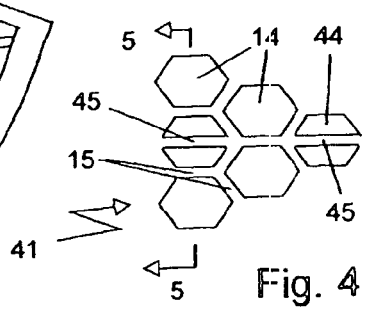
Fig. 4
Fig. 2
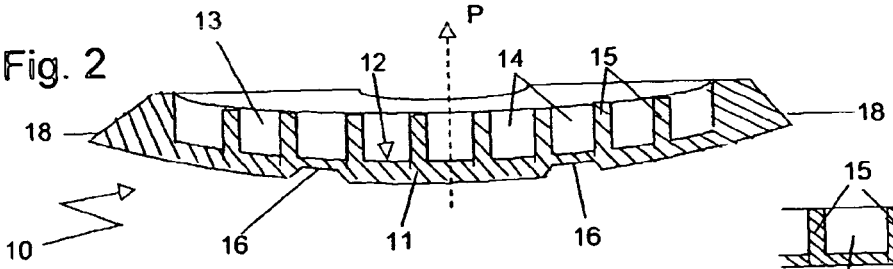
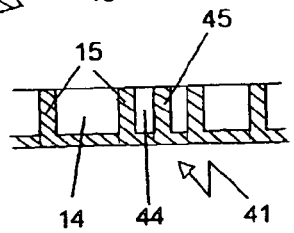
Fig. 5
Fig. 3
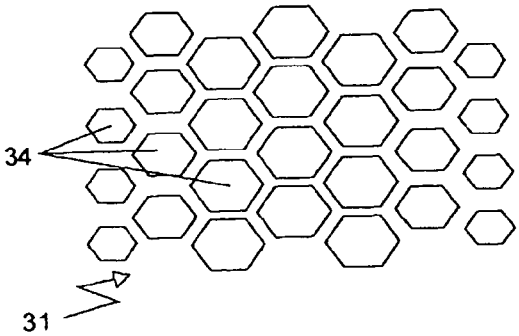
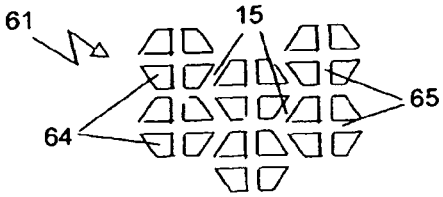
Fig. 6

PROTECTIVE BODY ARMOR

CROSS REFERENCE TO RELATED APPLICATION

This application is a continuation of copending International Application No. PCT/GB02/03998 filed Aug. 27, 2002 which designates the United States, and claims priority to Great Britain application no. 0122328.8 filed Sep. 15, 2001.

TECHNICAL FIELD OF THE INVENTION

The present invention relates to articles of protective body armour for sports, leisure, motor sport and industrial applications.

BACKGROUND OF THE INVENTION

Body armour is widely used in many sport and non-sporting applications to provide a level of protection from impact for the wearer. Conventional body armour consists of a hard plastics outer shell, injection moulded, blow moulded or thermoformed, with a lining of a softer compressible material, e.g. foamed material. The lining provides cushioning whilst the outer shell helps to distribute the impact load across a wider area, thus reducing direct, point loading. Body armour is normally secured to the wearer by means of strapping closure systems, e.g. elastic straps, touch and close fastenings, or by enclosure within garments worn by the user. A number of companies have, over the years, produced shock absorbing/energy protection devices in body armour and footwear utilising a honeycomb construction bonded to a rigid skin. The honeycomb structure consisting of hexagonal cells occurs in nature, e.g. by bees and wasps to make strong, lightweight, protective enclosures. The abstraction of good design from nature is the basis of biomimetics as applied in such disciplines as chemistry, engineering and materials science. Hence, honeycomb constructions bonded to an outer skin or skins are widely used in the aerospace and motor industries due to their superb lightweight/stiffness capability. In such cases, the honeycomb is bonded to the outer skin or skins by welding, adhesives or the like, and the bonding process adds considerably to the cost of production of the final product. U.S. Pat. No. 4,610,034 discloses a thin flexible lightweight protective pad for insertion into a pocket of a garment. The pad may have recesses of various shapes formed in one surface, thereby forming an integral structure similar to the above described skin/honeycomb constructions. The soft polyurethane foam material of the pad is readily deformable to allow for enhanced deceleration periods on impact and to provide a restoring force so that it does not "bottom-out" and act as a hard surface. The recesses are provided to allow for expansion or bulging of the material of the pad into those recesses. The object of the structure is to absorb recoil loads from a rifle, such loads being applied to the pad over the surface of the butt of the rifle. Such a readily deformable pad would not provide the required protection from point loads, e.g. bullet strikes, or loads applied over very small areas.

SUMMARY OF THE INVENTION

It is an object of the present invention to provide a protective body armour for sports, leisure, motor sport and industrial applications that is capable of dissipating the energy from point loads or loads applied over very small areas, that is less costly to manufacture than the known bonded shell/honeycomb constructions.

The invention provides a protective body armour comprising a skin and a honeycomb lining thereto, the skin and honeycomb lining being formed integrally with each other of a substantially non-deformable material.

The protective body armour may be injection moulded, blow moulded, sintered, vacformed or compression moulded as an integral construction. The protective body armour may be of polypropylene, polycarbonate, Nylon, Peebax™, polyethylene, polyurethane, K-Resin™ or Thermoplastic rubber. Preferably the honeycomb lining comprises hexagonal cells bounded by walls upstanding from the skin.

The protective body armour may be contoured, and may be cup-shaped. The lining may be on the concave face of the protective body armour. The cell walls may extend from the skin in a common direction parallel with the central perpendicular to the skin. The thickness of the skin may be non-uniform over the surface of the protective body armour. The protective body armour may have extending thereacross at least one fold line free from walls of the honeycomb to facilitate the conforming of the protective body armour to the contours of a person. The protective body armour may also have a cut extending along a portion of a fold line from the outer edge of the protective body armour. The cut may be tapered away from the outer edge. The size of the cells may be non-uniform over the surface of the protective body armour. The protective body armour may be substantially elliptical in planform.

The protective body armour may be coloured for external use, and may be translucent.

BRIEF DESCRIPTION OF THE DRAWING

The invention will now be described with reference to the accompanying drawings in which:

FIG. 1 is a plan view of one embodiment of body armour in accordance with the invention, FIG. 2 is a section on line 2—2 of FIG. 1, FIG. 3 is a plan view of a part of a second embodiment, FIG. 4 is a plan view of part of a third embodiment, FIG. 5 is a section on line 5—5 of FIG. 4, and FIG. 6 is a plan view of part of a fourth embodiment.

DESCRIPTION OF THE INVENTION

Referring now to FIGS. 1 and 2, there is shown a body armour 10 of substantially elliptical planform, comprising an outer skin 11 of cup-shaped form. On the concave side 12 of the outer skin 11 is a lining 13 formed integrally with the outer skin 11. The lining 13 is a honeycomb construction formed of hexagonal cells 14 bounded by walls 15 upstanding from the outer skin 11. The protective body armour 10 may be injection moulded, blow moulded, sintered, vacformed or compression moulded as an integral construction. To facilitate extraction of the body armour 10 from a mould, the cell walls 15 extend from the outer skin 11 in a common direction parallel with the central perpendicular P to the outer skin 11. The outer skin 11 and the lining 13 are of a substantially non-deformable material such as polypropylene, polycarbonate, Nylon, Peebax™, polyethylene, polyurethane, K-Resin™ or Thermoplastic rubber.

As can be seen in FIG. 3, the thickness of the outer skin 11 is non-uniform over the surface of the protective body armour 10. This variation in thickness provides fold lines 16 free from walls 15 of the honeycomb lining 13 extending across the body armour 10 to facilitate the conforming of the protective body armour 10 to the contours of a person wearing it. In addition, cuts 17 extend along a portion of a fold line 16 from the outer edge of the protective body armour 10. The cuts 17 are wedge-shaped and taper away from the outer edge 18.

In the embodiment of FIGS. 1 and 2, the size of the cells 14 is uniform over the surface of the protective body armour 10. However, in the case of the protective body armour 31 as shown in FIG. 3, the size of the cells 34 may be non-uniform over the surface of body armour 31 to accommodate flexing and for the ergonomic function of the body armour 31.

To stiffen the body armour further and provide enhanced shape retention, if required, alternative embodiments of body armour 41 and 61 as shown in FIGS. 4 and 5, and in FIG. 6 respectively may be produced. In these cases further cell walls 45 and 65 extend into some or all of the respective cells 44 and 64.

Generally the body armour 10, 31, 41, 61 is intended to be inserted in the clothing of the wearer. However, it may be desired to have the body armour 10, 31, 41, 61 attached to the outside of a garment. For such an application, the body armour 10, 31, 41, 61 may be of a coloured material, and may be translucent. For use both internally and externally of a garment, the body armour 10, 31,41, 61 of the invention provides good protection against impact loads, including ballistic loads or other loads applied over very small areas.

I claim:

1. A protective body armour comprising a skin and a honeycomb lining thereto, wherein the honeycomb lining comprises cells bounded by walls projecting upward from the skin and the body armour is contoured into a cup-shape with the lining on a concave face of the skin, wherein the skin and honeycomb lining are formed of a material that is substantially non-deformable, the skin and honeycomb lining are formed integrally with each other and the thickness of the skin is non-uniform over the surface of the protective body to form at least one fold line free from the walls of the honeycomb lining and relatively thinner to enable the protective body armour to conform to the contour of a person's body, wherein the honeycomb lining comprises hexagonal cells bounded by the walls, wherein the cell walls extend from the skin in a common direction parallel with a central reference line perpendicular to the skin.

2. The protective body armour according to claim 1, wherein the protective body armour is injected moulded as an integral construction.

3. The protective body armour according to claim 1, wherein the protective body armour is blow moulded as an integral construction.

4. The protective body armour according to claim 1, wherein the protective body armour is sintered as an integral construction.

5. The protective body armour according to claim 1, wherein the protective body armour is vacformed as an integral construction.

6. The protective body armour according to claim 1, wherein the protective body armour is compression moulded as an integral construction.

7. The protective body armour according to claim 1, wherein the body armour is formed of polypropylene.

8. The protective body armour according to claim 1, wherein the body armour is formed of polycarbonate.

9. The protective body armour according to claim 1, wherein the body armour is formed of Nylon.

10. The protective body armour according to claim 1, wherein the body armour is formed of polyethylene.

11. The protective body armour according to claim 1, wherein the body armour is formed of polyurethane.

12. The protective body armour according to claim 1, wherein the body armour is formed of thermoplastic rubber.

13. The protective body armour according to claim 1, wherein the body armour has a cut extending along a portion of a fold line from an outer edge of the body armour.

14. The protective body armour according to claim 13, wherein the cut is tapered away from the outer edge.

15. The protective body armour according to claim 1, wherein the size of the cells is non-uniform over the surface of the body armour.

16. The protective body armour according to claim 1, wherein the body armour is elliptical in platform.

17. The protective body armour according to claim 1, wherein the body armour is coloured.

18. The protective body armour according to claim 1, wherein the body armour is translucent.

* * * * *